US006357831B1

(12) United States Patent
Stoebe

(10) Patent No.: US 6,357,831 B1
(45) Date of Patent: Mar. 19, 2002

(54) EXCAVATION MACHINE FOR HARD ROCK MINING

(76) Inventor: Hans Dieter Stoebe, 2209 W. Parkhill Ave., Littleton, CO (US) 80120

( * ) Notice: Subject to any disclaimer, the term of this patent is extended or adjusted under 35 U.S.C. 154(b) by 0 days.

(21) Appl. No.: 09/231,204

(22) Filed: Jan. 14, 1999

(51) Int. Cl.[7] ..... E21C 27/24
(52) U.S. Cl. ..... 299/75
(58) Field of Search ..... 299/73, 75, 108, 299/112, 31, 79.1, 101, 85.2; 37/454, 465, 189, 452, 455

(56) References Cited

U.S. PATENT DOCUMENTS 3,413,033 A * 11/1968 Clark ..... 299/85.2 X
4,113,123 A * 9/1978 Jeffrey ..... 299/75 X
4,377,311 A * 3/1983 Seller ..... 299/75 X
4,548,442 A * 10/1985 Sugden et al. ..... 299/31 X
5,007,685 A * 4/1991 Beach et al. ..... 299/85.2 X
5,234,257 A * 8/1993 Sugden et al. ..... 299/31 X
5,890,771 A * 4/1999 Cass ..... 299/31
5,931,601 A * 8/1999 Terada et al. ..... 299/31 X

* cited by examiner

*Primary Examiner*—David Bagnell
*Assistant Examiner*—Sunil Singh
(74) *Attorney, Agent, or Firm*—Quinn & Quinn; Cornelius P. Quinn; William J. Quinn

(57) ABSTRACT

An excavation machine for hard rock mining which is relatively inexpensive, is mobile and versatile, is relatively light in weight (weighing no more than eight metric tons including power and control units and equipment for automation) and has the ability to make tight turns in any direction to follow a mineral vein and thereby avoid needless evacuation of undesired rock. The machine uses a cutter and reaming head mounted on a boom with two activator or rocker cylinders and excavates by applying a large impact or crushing cutting force in a repetitive manner, generally known as impact ripping.

4 Claims, 4 Drawing Sheets

EXCAVATION MACHINE FOR HARD ROCK MINING

BACKGROUND OF THE INVENTION

The present invention relates to an excavation machine and more particularly to an excavation machine which is ideal for hard rock mining and can be readily automated.

There exists in the hard rock mining industry a long felt need for mechanized evacuation techniques to take the place of drill and blast hard rock mining operations. The advantages of mechanized evacuation techniques and their adaptability to automation are well recognized.

PRIOR ART

Attempts to provide mechanical machines for hard rock mine excavation include road headers, continuous miners and modified versions of tunnel boring machines, or TBMs, as they are often referred to. Unfortunately, too date, these attempts have not been successful. These machines have suffered from maintenance problems, unacceptable bit wear and resulting high excavation costs. In addition, tunnel boring machines are still best suited for excavating long, relatively straight paths and do not have the capability to negotiate the tight turns necessary to follow ore veins.

In addition, these machines have been extremely costly and massive in size, weighing hundreds of metric tons. Lacking the desired mobility and versatility to follow desired mineral veins they are unable to avoid the excavation of rock which does not contain the desired minerals.

SUMMARY OF THE INVENTION

The basic object of the present invention is to provide an excavation machine which is relatively inexpensive, is mobile and versatile, is relatively light in weight (weighing no more than eight metric tons including power and control units and equipment for automation) and has the ability to make tight turns in any direction to follow a mineral vein and thereby avoid needless evacuation of undesired rock.

Another object of the invention is to provide an excavation machine for hard rock mining operations which use a cutter and reaming head mounted on a boom with two activator or rocker cylinders and excavates by applying a large impact or crushing cutting force in a repetitive manner, generally known as impact ripping.

Another object of the invention is to provide a "walking" mining machine with a partial face hard rock cutting reamer working member.

Yet another object of the present invention is to provide an excavating mining machine with adjustable bits in which operating space is provided to adjust the bits.

Still another object of the present invention is to provide new and improved composition drag bits for hard rock mining.

The present invention is a electro-hydraulic powered machine which can be easily automated and remotely controlled so as to significantly reduce the health and the safety risks associated with hard rock mining operations.

DETAILED DESCRIPTION OF THE INVENTION

Figure 1:
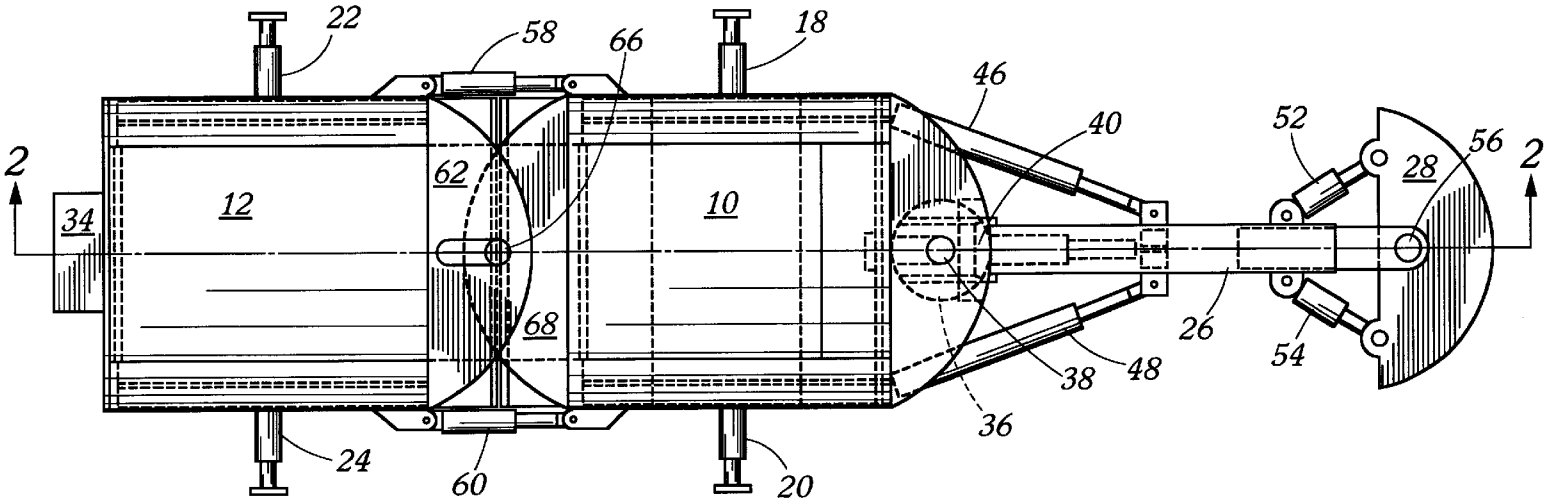
FIG. 1 is a top view of the excavation machine of the present invention minus the power and control units.
Figure 2:
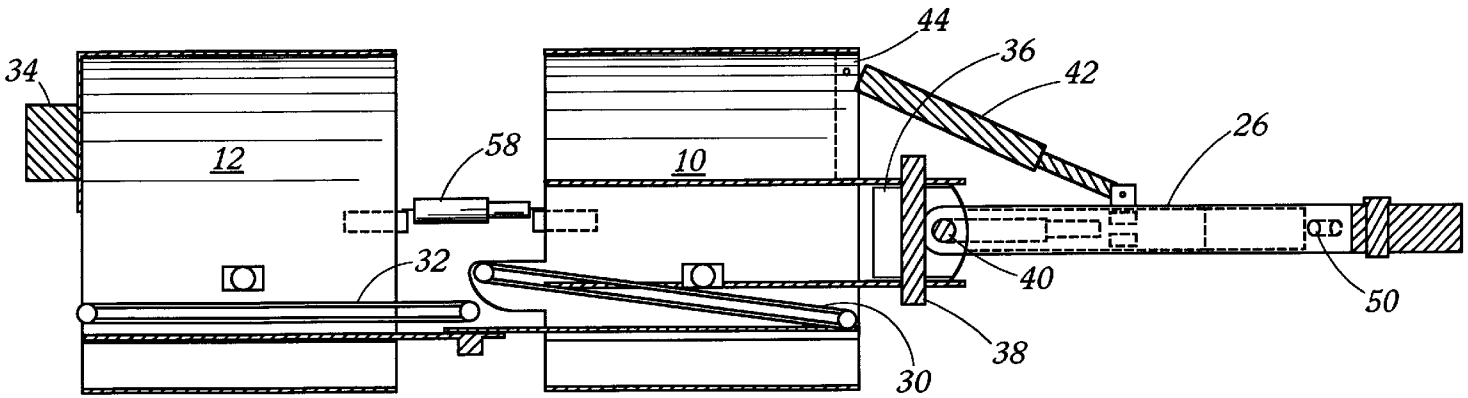
FIG. 2 is a side sectional view taken along A—A in FIG. 1.
Figure 3:
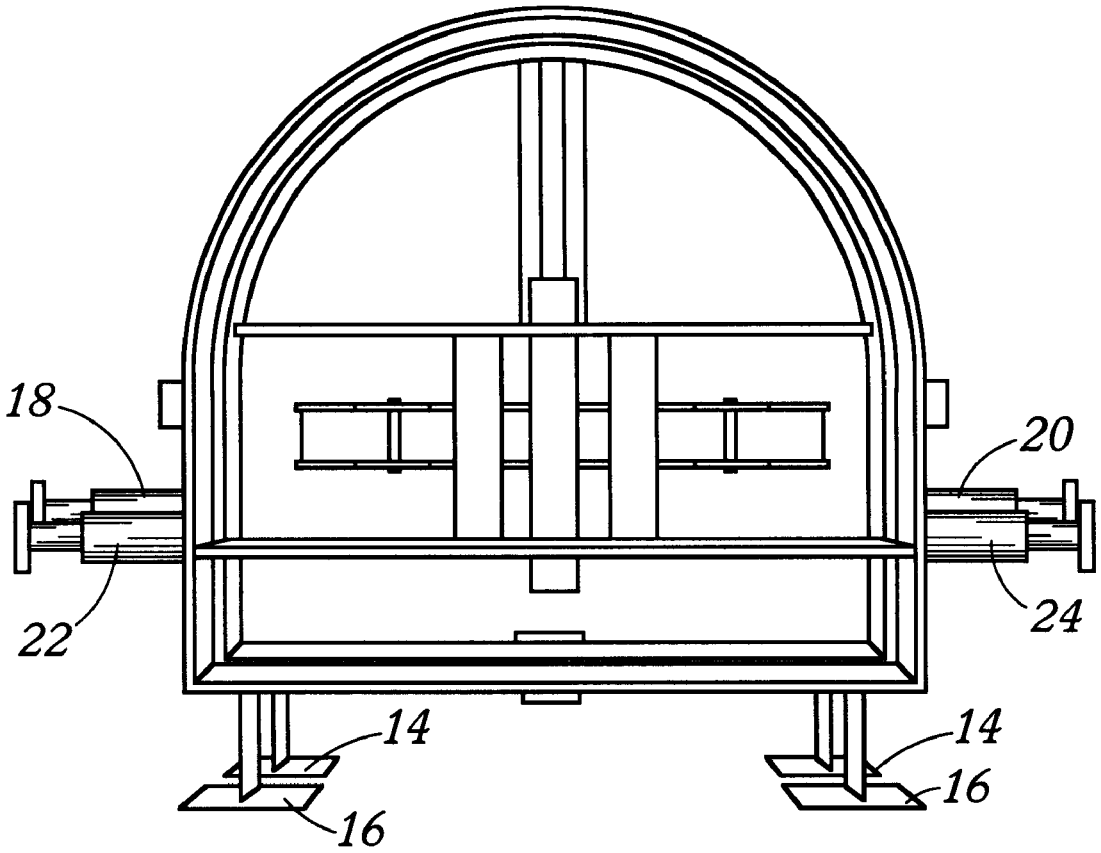
FIG. 3 is a rear end view of the excavation machine of the present invention shown in FIG. 1 minus the conveyors for removing rock and muck.

As shown in FIG. 1, the present invention incorporates two shield frame members. A front shield frame member 10 and a rear shield frame member 12. Each of the shield frame members is approximately 1140 mm high, 1225 mm wide, and 1120 mm long.

The shield frame members 10 and 12, in addition to carrying the impact and cutting mechanisms and power control units and automation equipment serve to protect the equipment from any falling debris.

Each of the shield frame members, 10 and 12, is mounted on a pair of steel skids 14 and 16, respectively. While additional hydraulic grippers may be employed, the front shield frame member 10 has at least two horizontal hydraulic thrust extending grippers, one 18, extending to the left and the other 20, extending to the right to engage and grip adjacent side walls. Likewise, while additional hydraulic thrust extending grippers may be employed, the back shield frame member 12 has at least two horizontal hydraulic thrust extending grippers, one 22 extending to the left and the other 24 extending to the right to engage and grip adjacent side walls.

Mounted on the front shield frame member 10 is a boom 26 which carries an impact and cutting reamer head 28, a device for breaking and cutting into hard rock. The front shield frame member 10 also carries gathering arms or a scoop (not shown) for gathering cut rock and muck and delivering it to a conveyor 30 where it is carried back for excavation.

The rear shield frame member 12 in addition to housing a conveyor 32 for carrying rock and muck also houses hydraulic pumps, a water pump, a cable reel for electric cable to connect to a power source, all of the controls necessary to operate the excavation machine and whatever automation equipment that is desired. A control station 34 may be provided on the rear shield frame member 12 for an operator or at a remote site by using conventional robotic control systems (not shown).

The boom 26 is mounted on a swivel head 36 having a vertical pin 38 about which it moves laterally left and right and a horizontal pin 40 about which it moves vertically up and down. A hydraulic power cylinder 42 extending from a frame member 44 in front shield frame member 10 to the boom 26 controls the movement of the boom 26 in a vertical direction about the horizontal pin 40.

A hydraulic motor (not shown) or two hydraulic power cylinders, 46 and 48, connected to front shield frame member 10 and the boom 26 are provided to move the boom left and right about the pin 38.

A hydraulic feed cylinder 50 inside the boom 26 is provided to move the cutter head 26 forward with a force of twelve metric tons into a rock face to be cut. A pair of hydraulic cylinders 52 and 54 on the left and right of the boom 26 are connected to the cutter head 28 to pivot the cutter head 28 left and right about a mounting pin 56 with a cutting and reaming force of seventy metric tons.

The front shield frame member 10 and the rear shield frame member 12 are connected together by a pair of hydraulic cylinders 58 and 60. As illustrated in FIG. 1 rear shield frame member 12 has a spherical plate 62 extending forward therefrom with a longitudinal slot therein for receiving a vertical pin 66 protruding from a spherical plate 68 extending from the rear portion of the front shield frame member 10.

A significant feature of the present invention is employing the concept of raised boring techniques or the use of drag bits in hard rock mining. Previous attempts to use drag bits in hard rock mining were unsuccessful due to the short life of the drag bits and the significant costs incurred in replacing them.

In the past the drag bits were welded on the cutter heads and when the bits broke or shattered or wore out it was necessary to replace the complete cutter head which was obviously very expensive.

In the present invention the bits are made of a new alloy which is much stronger than previous alloys. A new alloy which has been found to provide desired performance in drag bits comprise generally in % by weight, tungsten-carbide 75%, nickel 5%, cobalt 5%, hafnium 2.5%, uranium 2.5%, tantalum 5%, and niobium 5%.

Figure 5:
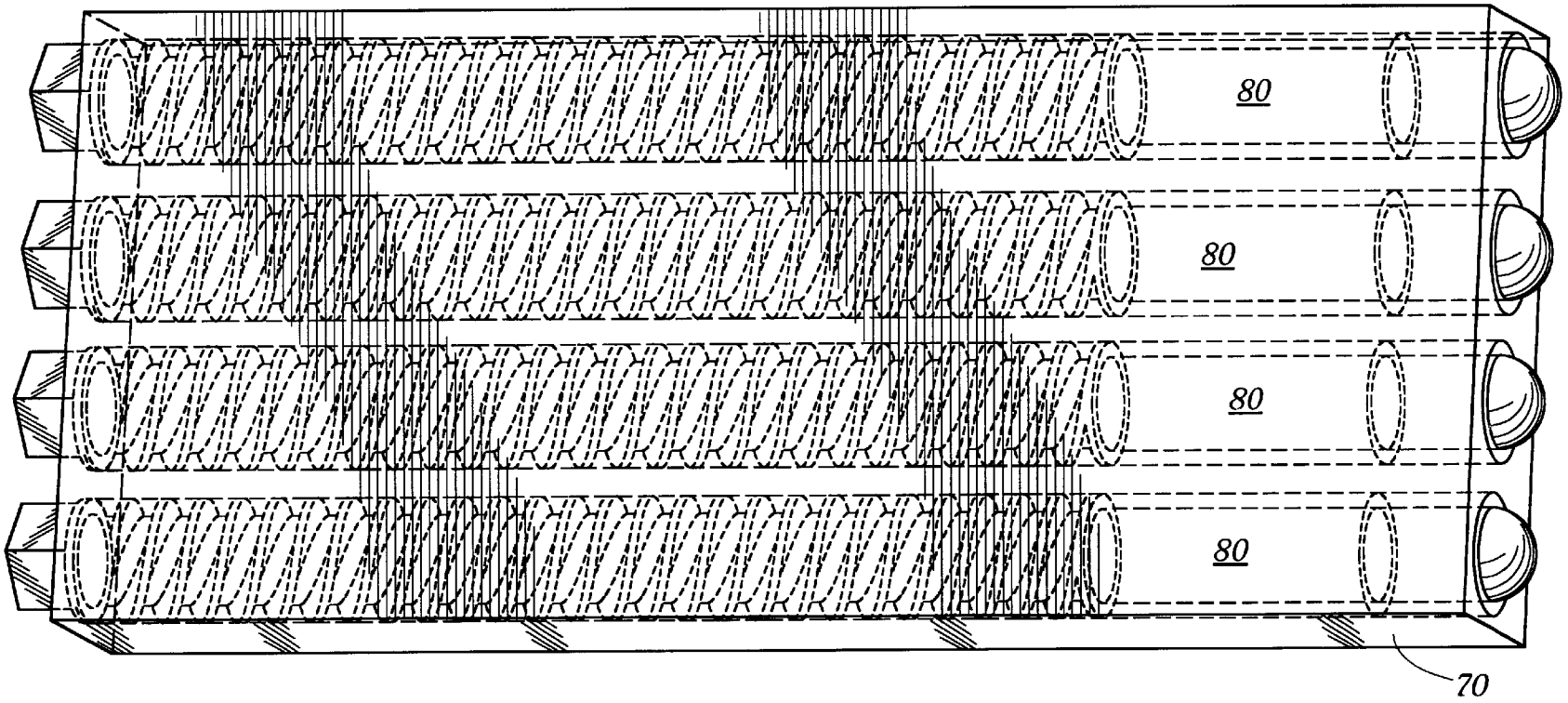
FIG. 5 is a cut away view of one of the drag bit holder mountings of the present invention.

In addition, in the present invention as shown in FIG. 5, the bits are welded to longitudinal extensions 80 having impact proof round threads adapted to engage impact proof round threads in a mounting bit holder member 70, which enable the bits to be advanced forward to overcome the effects of wear. The mounting bit holder members are welded to the cutter head.

Figure 4:
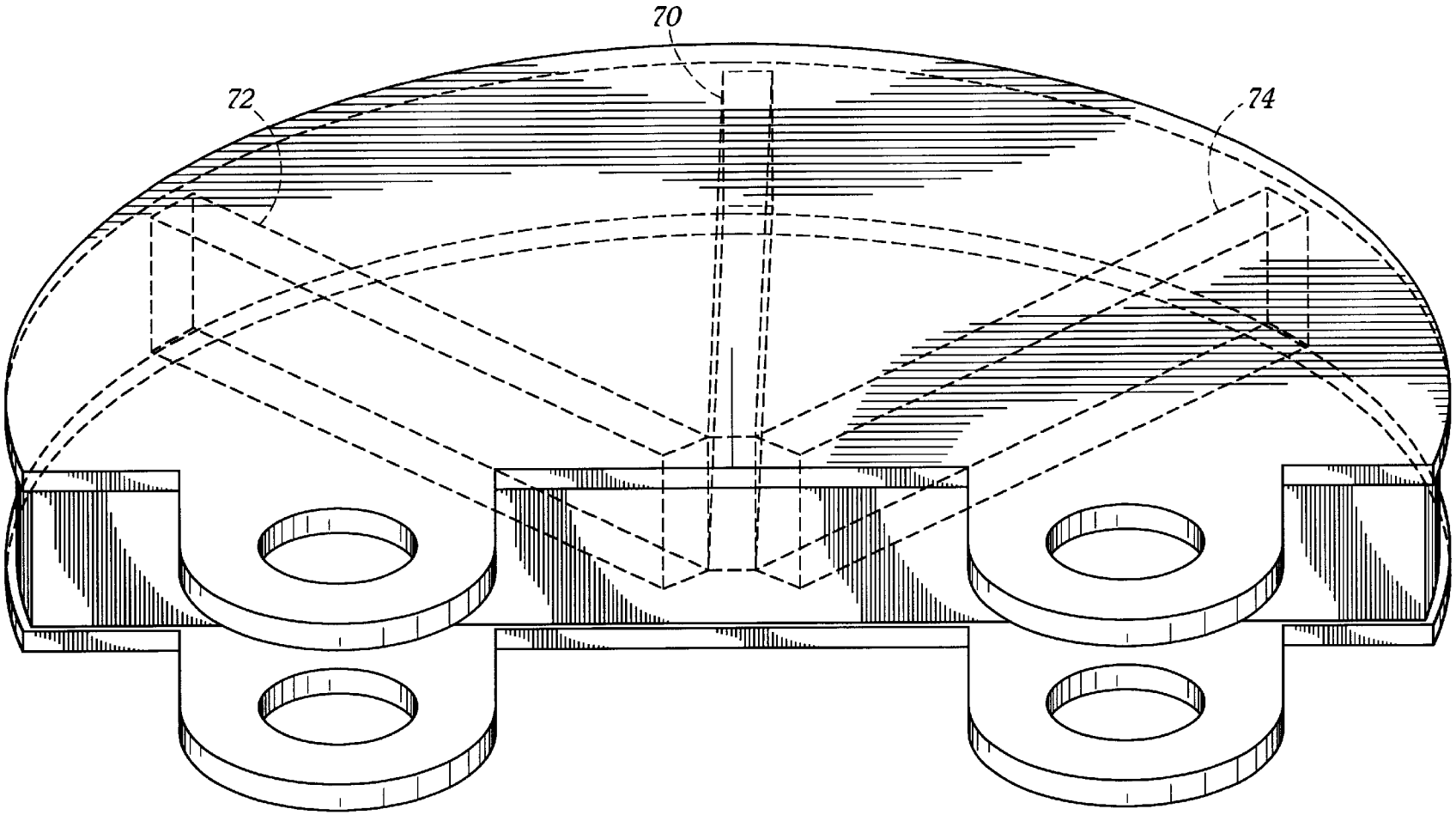
FIG. 4 is a perspective view of the cutting head of the present invention cut away to show the slots for the insertion of the drag bit holder mountings.

As illustrated in FIG. 4 access is provided to the end of these longitudinal extensions in order that the extensions may be manually adjusted advancing each of the bits during periodic maintenance.

As illustrated in FIG. 4, the cutting head 28 houses three bit holder members, 70, 72, and 74, each of which has four bits. For more effective cutting the bits in the center bit holder member 70 have ballistic shaped heads and the bits in the side bit holder members 72 and 74 have dome shaped heads.

In operation, the machine of the present invention starts in a conventional starting chamber having a face, a roof, and side walls with the hydraulic grippers 18 and 20 thrust into contact with the side walls securing the front shield frame member 10 firmly in place. Similarly, the hydraulic grippers 22 and 24 are thrust into contact with the side walls and secure the rear shield frame member 12 firmly in place.

Through the control of the hydraulic power cylinder 42 the boom 26 moves the cutting head 28 to the bottom of the rock face to be cut. The feed cylinder 50 presses the cutter head 28 forward against the rock face to be cut with a force of twelve metric tons and power cylinders 52 and 54 move the cutter head 28 back and forth left and right about the pin 56 with an impact and cutting force of seventy metric tons so that all of the drag bits cut into the face of the rock. The power cylinders 46 and 48 are used to move the boom 26 left or right to cut a path more to the left or right to initiate left or right turns.

Spray nozzles (not shown) are provided in the cutting head 28 for cooling the bits and wetting down the rock dust during the cutting of the rock. After the rock is cut to a depth of approximately 250 mm, the feed cylinder 50 retracts the cutter head 28 from the rock face, the power cylinder 42 moves the boom 26 and the cutter head 28 up 500 mm, the feed cylinder 50 presses the cutter head forward against the face of the rock with a force of twelve metric tons and the power cylinders 52 and 54 again move the cutter head 28 back and forth left and right about the pin 56 whereby the drag bits cut into the face of the rock with an impact and cutting force of seventy metric tons. These steps are repeated until the entire face of the rock has been cut. As the rock is cut it is scooped up and carried by conveyors out the back of the machine.

When a complete cut is made of the rock face, the thrust of the hydraulic pressure of the grippers 18 and 20 is reduced releasing the front shield frame member 10 from the side walls, the hydraulic cylinders 58 and 60 then push the front shield frame member 10 forward, the thrust of the hydraulic pressure of the grippers 18 and 20 is again increased to grip the side walls and hold the front shield frame member 10 firmly in place, the thrust of the hydraulic pressure in grippers 22 and 24 is reduced releasing the rear shield frame member 12 from the side walls, and the hydraulic cylinders 58 and 60 move the rear shield frame member forward. The thrust of the hydraulic pressure in the grippers 22 and 24 is then increased to grip the side walls and hold the rear shield frame member 12 rigidly in place while the cutter head proceeds through another cutting cycle.

The excavation machine is made to turn to the left by having the cylinders 48 and 46 move the boom 26 and cutter head 28 to the left and concentrate the cutting of the rock on the left. The front shield frame member 10 is made to follow the left cut by decreasing the thrust of the hydraulic pressure of the gripper 18 and increasing the thrust of the hydraulic pressure of the gripper 20. Likewise, to turn to the right the cutter head 28 cuts more to the right and the thrust of the hydraulic pressure is increased in the gripper 18 and decreased in the gripper 20. Similarly, since the boom 26 carrying the cutting head 28 can be moved up and down, the machine can proceed upwardly or downwardly along any gradient to follow a vein of ore.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A partial face rock cutting and reaming machine comprising, a round sector of a wheel shaped cutting and reaming head having a number of bits mounted thereon, hydraulic means for forcing the cutting and reaming head forward into a rock face, and hydraulic means connected to the round sector of the wheel shaped cutting and reaming head for reciprocating the cutting and reaming head back and forth, left and right in a cutting motion into said rock face, a boom for carrying said round sector wheel shaped cutting and reaming head, said boom including said hydraulic means for forcing the cutting and reaming head into said rock face, a front frame member shield and boom mounting means carried by said front frame member shield enabling the boom to be hydraulically moved in horizontal and vertical planes.

2. A partial face hard rock cutting and reaming machine as defined in claim 1, movable stepwise in a heading having side walls and a face to be worked, said front frame member shield having at least one gripper for applying thrust and relieving thrust to each side wall, and a rear frame member shield having at least one gripper for applying thrust and relieving thrust to each side wall, and hydraulic means connecting said front frame member shield and said rear frame member shield so as to move each of said frame member shields relative to the other.

3. A partial face hard rock cutting and reaming machine as defined in claim 1, wherein the cutting and reaming head has a vertical row of bits positioned at its center face and a vertical row of bits an equi-distance on each side from the vertical row positioned at the center, and each of said vertical row of bits includes four bits spaced equi-distant from each other, and said bits in said center vertical row are ballistic shaped and said bits in the other vertical rows are domed shaped.

4. A partial face hard rock cutting and reaming machine as defined in claim 1, including a mechanism for extending the life of the impact and cutting bits comprising, a longitudinal extension member secured to each of the bits and mounting bit holder members for holding the bits and the longitudinal extension members, said longitudinal extension members each having impact proof rounded threads for engagement with impact proof rounded threads formed in said mounting bit holder members, whereby when the contact face of one of the bits becomes worn turning the longitudinal extension member will advance the bit into an impact and cutting position and wherein the composition of the bits comprise generally in percentage by weight, tungsten carbide 75%, nickel 5%, cobalt 5%, hafnium 2.5%, uranium 2.5%, tantalum 5%, and niobium 5%.

* * * * *